US008142220B2

(12) United States Patent
Burns

(10) Patent No.: US 8,142,220 B2
(45) Date of Patent: Mar. 27, 2012

(54) CONNECTOR WITH A CONFIGURATION AID ON ITS OUTER SHELL OR AN INSULATIVE BODY DISPOSED IN THE OUTER CELL

(76) Inventor: Jonathan C. Burns, Brookings, SD (US)

( * ) Notice: Subject to any disclaimer, the term of this patent is extended or adjusted under 35 U.S.C. 154(b) by 0 days.

(21) Appl. No.: 12/986,555

(22) Filed: Jan. 7, 2011

(65) Prior Publication Data

US 2011/0165792 A1 Jul. 7, 2011

Related U.S. Application Data

(60) Provisional application No. 61/293,083, filed on Jan. 7, 2010.

(51) Int. Cl.
*H01R 3/00* (2006.01)

(52) U.S. Cl. ..... 439/488

(58) Field of Classification Search ..... 439/488–491, 439/86, 680, 955, 188
See application file for complete search history.

(56) References Cited

U.S. PATENT DOCUMENTS

| | | | | |
|---|---|---|---|---|
| 4,902,244 | A * | 2/1990 | Endo et al. | 439/489 |
| 5,169,329 | A * | 12/1992 | Taguchi | 439/188 |
| 5,169,336 | A * | 12/1992 | Taguchi | 439/489 |
| 5,588,873 | A * | 12/1996 | Hamai et al. | 439/489 |
| 7,568,933 | B2 * | 8/2009 | Shirai et al. | 439/271 |
| 7,980,886 | B2 * | 7/2011 | Liu | 439/488 |
| 8,029,313 | B2 * | 10/2011 | Fendrock et al. | 439/489 |
| 2009/0269974 | A1 * | 10/2009 | Liu | 439/488 |

* cited by examiner

*Primary Examiner* — Chandrika Prasad
(74) *Attorney, Agent, or Firm* — Barbara A. Wrigley; Oppenheimer Wolff & Donnelly, LLP

(57) ABSTRACT

An electronic connector comprises an outer shell having a first side and a second side, an insulative seat body having a first side and a second side, a plurality of terminals extending along the first side of the insulative seat body, and a configuration aid formed on the outer shell. The insulative seat body is disposed within an interior of the outer shell such that the first side of the insulative seat body is oriented toward the first side of the outer shell and the second side of the insulative seat body is oriented toward the second side of the outer shell. The configuration aid is structured to indicate the orientation of the terminals with respect to the first side of the outer shell.

20 Claims, 7 Drawing Sheets

CONNECTOR WITH A CONFIGURATION AID ON ITS OUTER SHELL OR AN INSULATIVE BODY DISPOSED IN THE OUTER CELL

CROSS REFERENCE TO RELATED APPLICATIONS

This application claims priority to U.S. provisional application Ser. No. 61/293,083, filed Jan. 7, 2010, which is hereby incorporated by reference in its entirety.

BACKGROUND OF THE INVENTION

The present invention relates generally to electronic connectors. More particularly, the present invention relates to electronic connectors that allow a user to quickly and easily determine the proper orientation of the connector with respect to a receptacle within which it is structured to be received.

One non-limiting context in which this situation arises is with a Universal Serial Bus. A Universal Serial Bus ("USB") is an external bus that supports plug and play installation. Particularly, USB is a specification to establish communication between devices and a host controller such as a personal computer. Using a USB receptacle of a computer system, a user may connect and disconnect devices without shutting down or restarting the computer. For example, a USB receptacle may be used to connect peripheral devices such as speakers, telephones, CD-ROM drives, joysticks, tape drives, keyboards, scanners, memory drives, and cameras.

Flash drives represent a class of non-volatile semiconductor flash memory, and are typically embodied as a small hand-held portable device that contains a USB connector as an integral part of the device. The USB connector is inserted during use into a USB receptacle of a host system such as a personal computer, notebook computer, portable digital assistant (PDA), or the like. The memory system within the flash drive is electronically connected to the host system through the USB connector for transferring data therebetween. The memory system also receives operating power through the USB connector.

One common problem encountered by users of a variety peripheral devices, such as USB connectors, centers around determining the proper orientation of the connector with respect to the receptacle. This problem is described herein with respect to determining the proper orientation of a USB connector with respect to the USB receptacle, but it is understood that the difficulty of orienting a variety of connectors with respect to their corresponding receptacles is ubiquitous and arises with a variety of other devices, electrical connectors, and the like. As appreciated by those skilled in the art, a USB connector may only be inserted into a USB receptacle in one particular orientation. Typically, a user of a peripheral device with a USB connector will attempt to insert the connector into the USB receptacle in a first orientation. If the connector does not "fit" within the receptacle, the user will rotate the peripheral device by 180 degrees to arrive at the proper orientation. Thus, the user has a 50-50 chance of guessing the correct orientation of the device on the first attempt. What is needed is a configuration aid that allows a user to correctly orient the connector of any device with respect to its receptacle on the first attempt.

BRIEF SUMMARY OF THE INVENTION

The present invention solves the foregoing problems by providing an electronic connector including an outer shell having a first side and a second side, an insulative seat body having a first side and a second side, a plurality of terminals extending along the first side of the insulative seat body, and a configuration aid formed on the outer shell. The insulative seat body is disposed within an interior of the outer shell such that the first side of the insulative seat body is oriented toward the first side of the outer shell and the second side of the insulative seat body is oriented toward the second side of the outer shell. The configuration aid is structured to indicate the orientation of the terminals with respect to the first side of the outer shell.

DETAILED DESCRIPTION OF THE INVENTION

Generally speaking, the present invention is directed to a configuration aid for properly orienting a connector with respect to a corresponding receptacle. The configuration aid may be used with any type of electronic connector, including but not limited to Universal Serial Bus ("USB") connectors, USB 2.0 connectors, mini-USB connectors, FireWire connectors, Serial ATA (SATA or Serial Advanced Technology Attachment), eSATA, and the like. Furthermore, the electronic connector may be coupled to any suitable peripheral device or cable as will be appreciated by those skilled in the art.

In the exemplary embodiments set forth herein, the configuration aid of the present invention will be described with reference to a male USB connector that forms the interface of a flash drive and that is structured to be received by a female USB receptacle. However, the present invention is described with reference to USB connectors on flash drives merely for purposes of example and not limitation. Thus, the configuration aid may be used with any type of electronic connector that is coupled to any suitable peripheral device without departing from the intended scope of the present invention.

Figure 1:
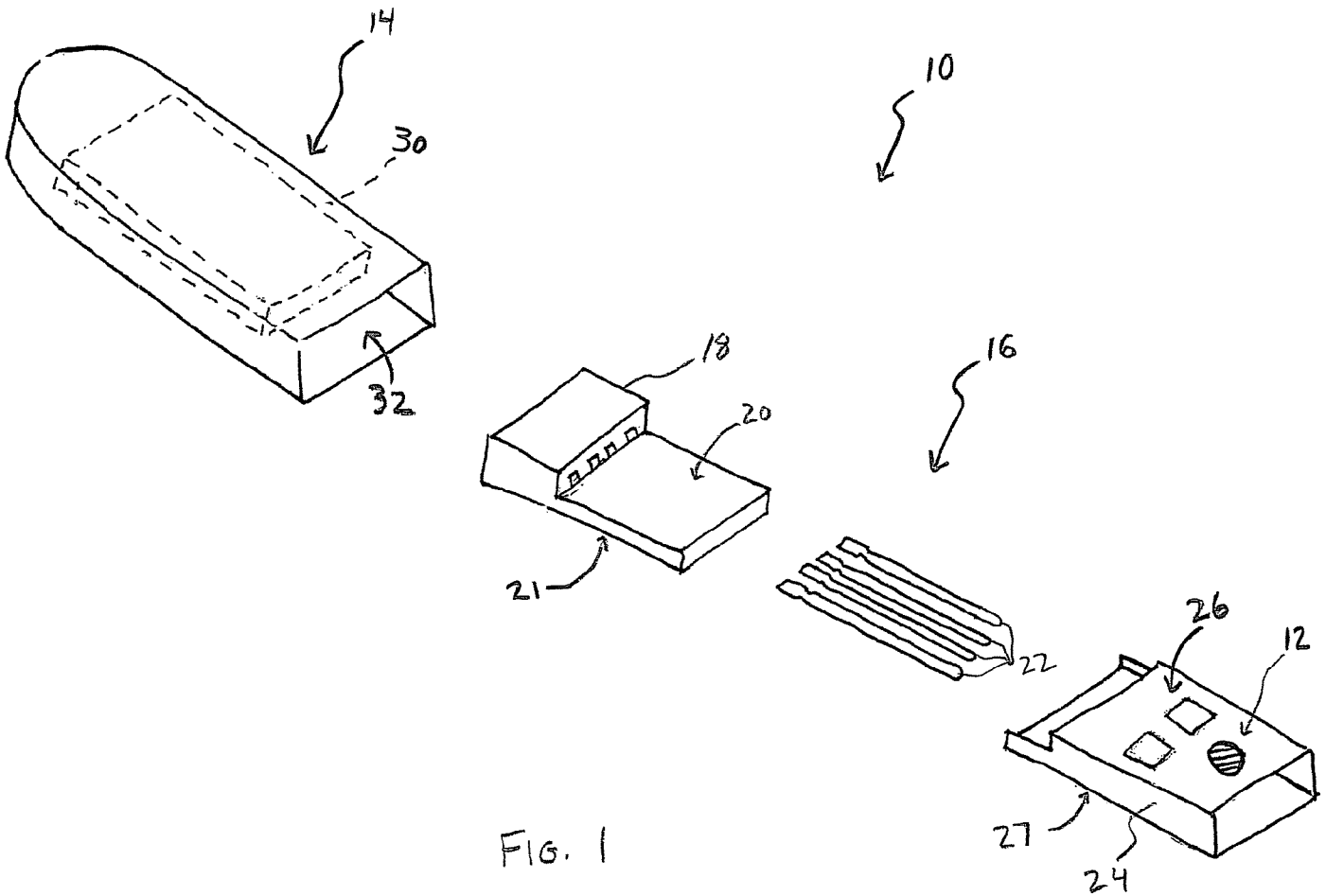
FIG. 1 is a perspective view of a flash drive having a first exemplary embodiment of a configuration aid in accordance with the present invention.

FIG. 1 is an exploded perspective view of a flash drive 10 having a first exemplary embodiment of a configuration aid 12 in accordance with the present invention. As illustrated in FIG. 1, flash drive 10 includes a flash drive housing 14 and a Standard-A type USB electronic connector 16. As appreciated by those skilled in the art, the Standard-A type USB connector resembles a flattened rectangle that is structured to be received within a downstream-port receptacle on a USB host or hub. Such USB connectors carry both power and data, and may be coupled directly to a peripheral device such as flash drive 10, or alternatively to a cable that is permanently or detachably coupled to another device.

The connector 16 generally includes an insulative seat body 18 that has a top or first side 20, a bottom or second side 21, and a plurality of terminals 22 that are structured to be mounted on the first side 20 of the insulative seat body 18. The connector 16 further includes an outer shell 24 that is structured to receive the insulative seat body 18. The outer shell 24 includes a top or first side 26 that is adjacent to the first side 20 of the insulative seat body 18 and a bottom or second side 27 that is adjacent to the second side 21 of the insulative seat body 18 when assembled. As will be discussed in further detail to follow, the configuration aid 12 of the present invention may be formed at least in part on the top or first side 26 of the outer shell 24.

As illustrated in FIG. 1, the flash drive housing 14 includes a printed circuit board 30 disposed therein. The printed circuit board may include, for example, a mass storage controller device, one or more flash memory chips, and a crystal oscillator. When assembled, the connector 16 is structured to be received into an open end 32 of the flash drive housing 14 as illustrated in FIG. 2.

Figure 2:
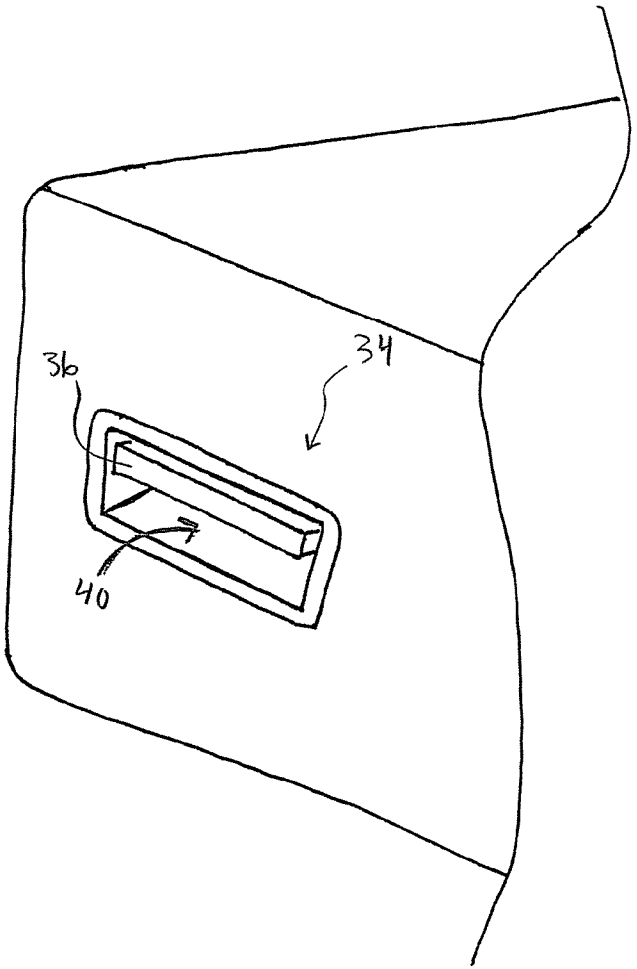
FIG. 2 is a perspective view of the flash drive of FIG. 1 positioned adjacent to a female receptacle.
Figure 2:
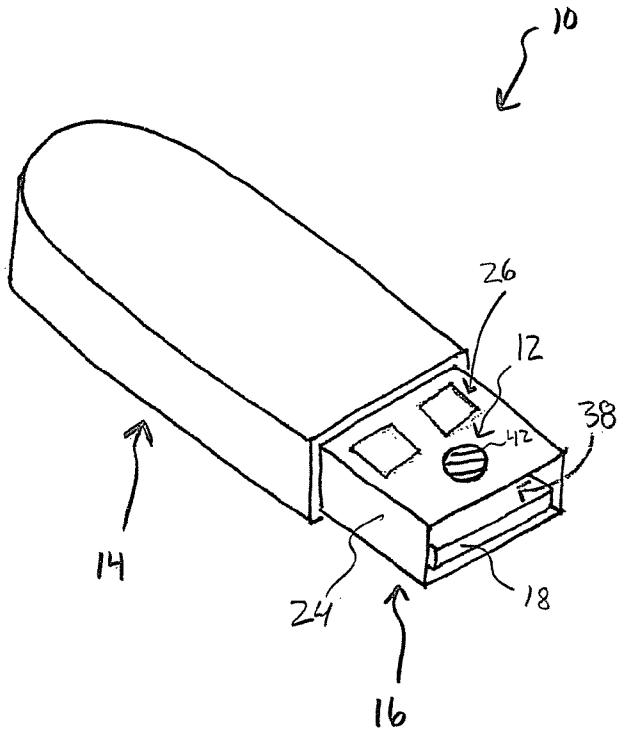

FIG. 2 is a perspective view of the flash drive 10 positioned adjacent to a female USB receptacle 34. The receptacle 34 generally includes a body 36 on an upper end thereof that includes a plurality of terminals (not shown) that are structured to contact the terminals 22 of the connector 16 in order to electronically couple the flash drive 10 to the receptacle 34. When inserted into the receptacle 34, the body 36 is received within a connector slot 38 adjacent the first side 26 of the outer shell 24, while the insulative seat body 18 is received within a receptacle slot 40 adjacent to a lower end of the receptacle 34.

In the majority of applications that offer USB connections, the USB receptacle is oriented as illustrated in FIG. 2. As appreciated by those skilled in the art, USB receptacles and connectors are "asymmetrical" such that a USB connector may only be inserted into a USB receptacle in one particular orientation. In order to electronically couple the flash drive 10 to the receptacle 34, the user must orient the connector 16 such that the top side 26 of the outer shell 24 is facing upward to allow the seat body 18 of the connector 16 and the body 36 of the receptacle 34 to be received within their corresponding slots 40 and 38.

Due to the fact that what makes the USB connector device asymmetrical is not the exterior shape but rather the interior structure, it is difficult for a user to determine the proper orientation of the USB connector by simply viewing the exterior of the flash drive and attached USB connector. As a result, a user of a flash drive will typically attempt to insert the USB connector into the USB receptacle in a first orientation. If the connector does not "fit" within the receptacle, the user will rotate the flash drive by 180 degrees to arrive at the proper orientation. Thus, the user has a 50-50 chance of guessing the correct orientation of the device on the first attempt.

The present invention allows the user to properly orient the connector on the first attempt by providing the configuration aid 12. As illustrated in FIGS. 1 and 2, the configuration aid 12 is a geometrical shape 42 on the first side 26 of the outer shell 24 having a color that is different than the color of the outer shell. More particularly, the geometrical shape 42 of FIGS. 1 and 2 is illustrated as a circle that is colored green. However, any geometrical shape may be used as will be appreciated by those skilled in the art. Furthermore, any color, pattern, or surface feature that allows the geometrical shape 42 to be distinguished from the outer surface of the shell 24 may be used without departing from the intended scope of the present invention. Thus, a green circular element is described merely for purposes of example and not limitation.

As will be appreciated by those skilled in the art, the configuration aid 12 is designed to allow the user to quickly and easily determine the proper orientation of the flash drive 10 with respect to the receptacle 34. With regard to the embodiment of FIGS. 1 and 2, the green geometrical shape 42 of the configuration aid 12 indicates to the user which side is the top or first side 26 of the outer shell 24 of the connector 16. By knowing which side is the first side 26, the user can properly orient the connector 16 with respect to the receptacle 34 on the first attempt because the user knows that the first side 26 must be facing in the upward direction to allow the connector 16 to be inserted into the asymmetrical receptacle 34.

Figure 3B:
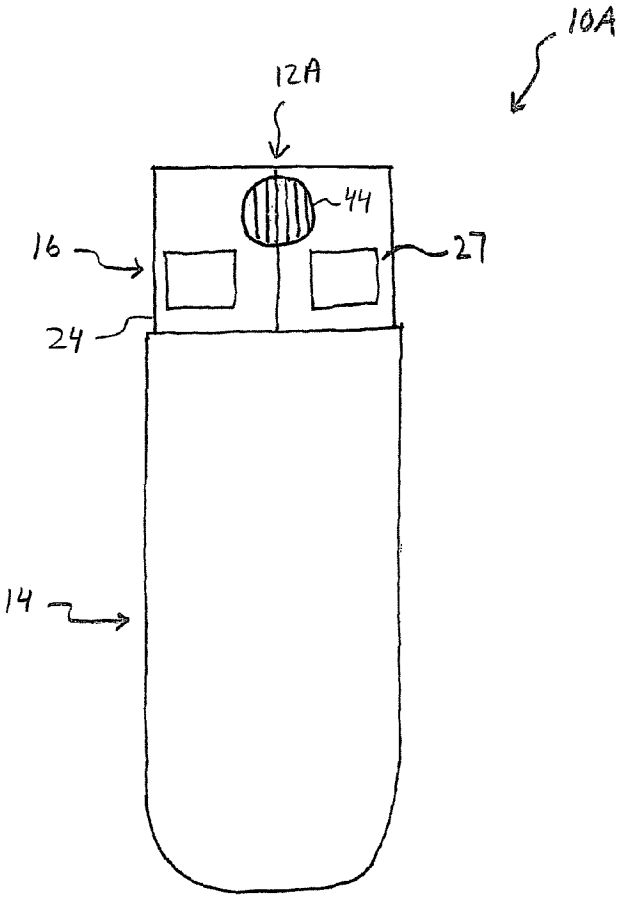
FIGS. 3A and 3B are top and bottom views, respectively, of a flash drive having a second exemplary embodiment of a configuration aid in accordance with the present invention.
Figure 3A:
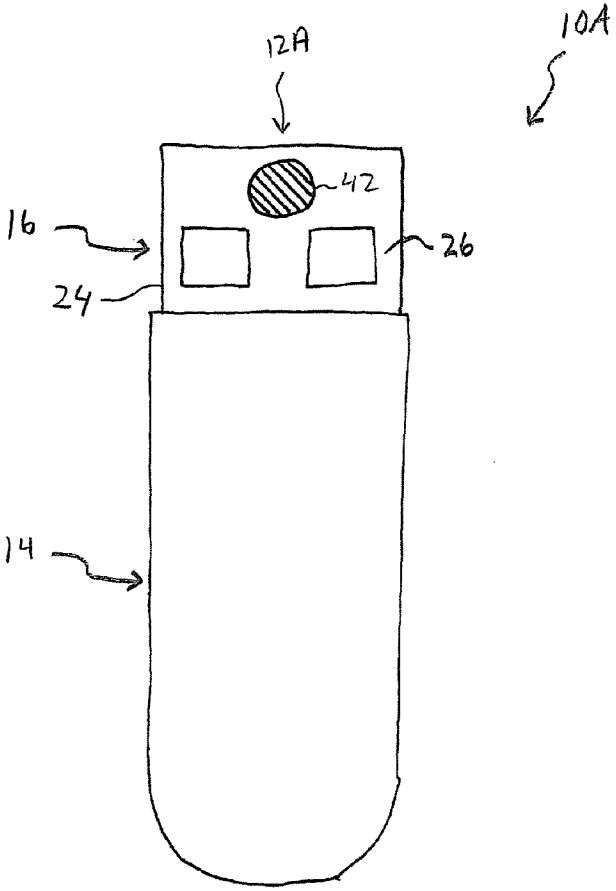

FIGS. 3A and 3B are top and bottom views, respectively, of a flash drive 10A having a second exemplary embodiment of a configuration aid 12A in accordance with the present invention. As illustrated in FIGS. 3A and 3B, configuration aid 12A is similar to configuration aid 12 of FIGS. 1 and 2, but further includes a second geometrical shape 44 on the bottom or second side 27 of the outer shell 24 of the connector 16. The second geometrical shape 44 has a color that is different than both the color of the outer shell 24 and the geometrical shape 42.

More particularly, the geometrical shape 42 is illustrated as a circle that is colored green, while the second geometrical shape 44 is illustrated as a circle that is colored red. However, any geometrical shape and colors or patterns that allow the user to distinguish between the first side 26 and the second side 27 of the outer shell 24 may be used as will be appreciated by those skilled in the art. Thus, green and red circular elements are described merely for purposes of example and not limitation.

In use, the user may pick-up the flash drive 10A for insertion into a receptacle. Consider first a scenario where the user grasps the flash drive 10A and the red circle defining the second geometrical shape 44 is facing upward. In order to properly orient the flash drive 10A with respect to the receptacle 34 illustrated in FIG. 2, the red circle will indicate to the user that the flash drive 10A must be rotated by 180 degrees such that the green circle defining the geometrical shape 42 is instead facing upward. Upon rotating the flash drive such that the geometrical shape 42 is facing upward, the flash drive 10A will be properly oriented with respect to the receptacle. Thus, the second geometrical shape 44 is designed to provide an additional means of alerting the user that the connector 16 of the flash drive is not oriented properly for insertion into the receptacle.

Figure 4:
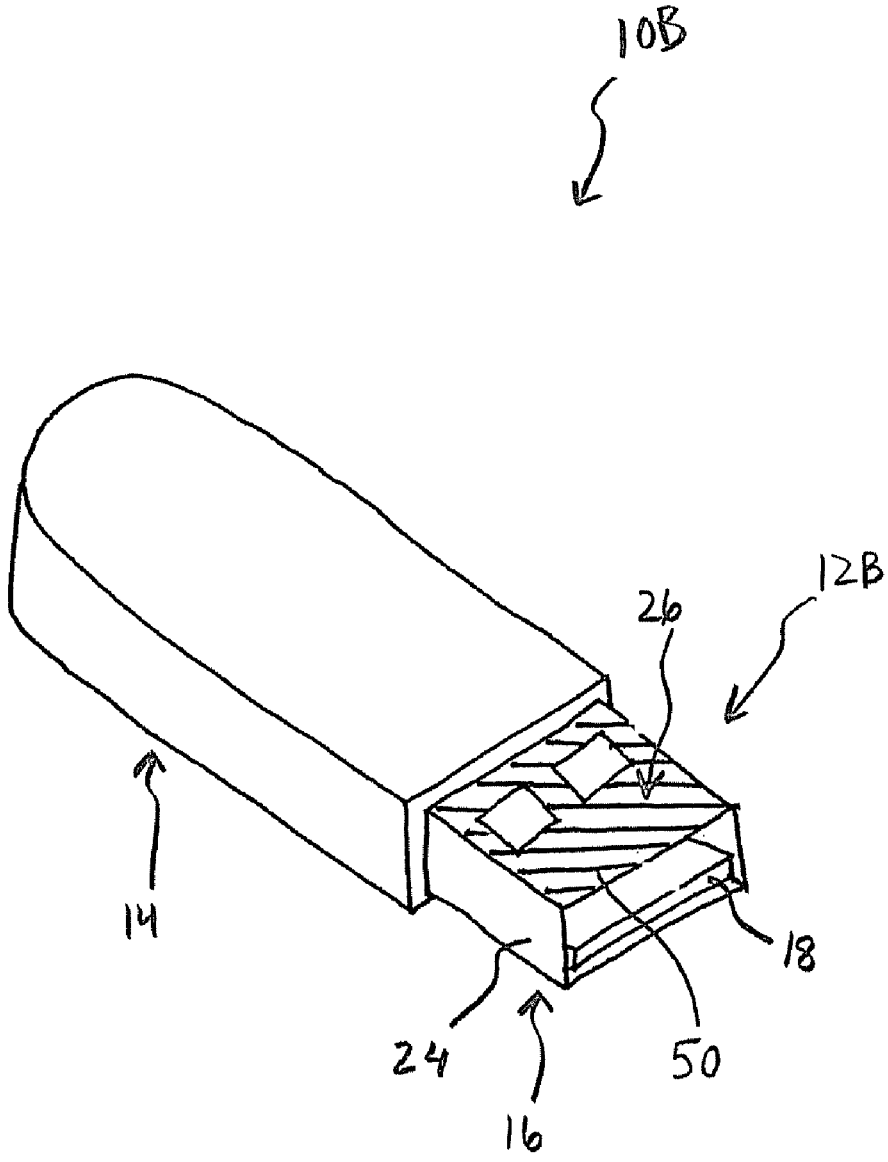
FIG. 4 is a perspective view of a flash drive having a third exemplary embodiment of a configuration aid in accordance with the present invention.

FIG. 4 is a perspective view of a flash drive 10B having a third exemplary embodiment of a configuration aid 12B in accordance with the present invention. As illustrated in FIG. 4, configuration aid 12B is similar to configuration aid 12 of FIGS. 1 and 2. However, the geometrical shape 42 has been replaced by a colored surface 50 defined by a color that is different than the color of the remaining portions of the outer shell. More particularly, the colored surface 50 is illustrated as extending across the entire first side 26 of the outer shell 24 and being green in color. However, those skilled in the art will appreciate that it is not necessary to have the colored surface 50 extend across the entire first side 26. Thus, in other embodiments the colored surface may extend across only a portion of the first side 26 of the outer shell 24. Furthermore, any color, pattern, or surface feature that allows the configuration aid 12B to be distinguished from the remaining portions of the outer shell 24 may be used. Thus, a green colored surface is described merely for purposes of example and not limitation.

Similar to the green colored circle 42 of configuration aid 12, the green colored surface 50 of configuration aid 12B indicates to the user which side is the top or first side 26 of the outer shell 24 of the connector 16. By knowing which side is the first side 26, the user can properly orient the connector 16 with respect to a corresponding receptacle on the first attempt as previously described with reference to FIG. 2.

Figure 5B:
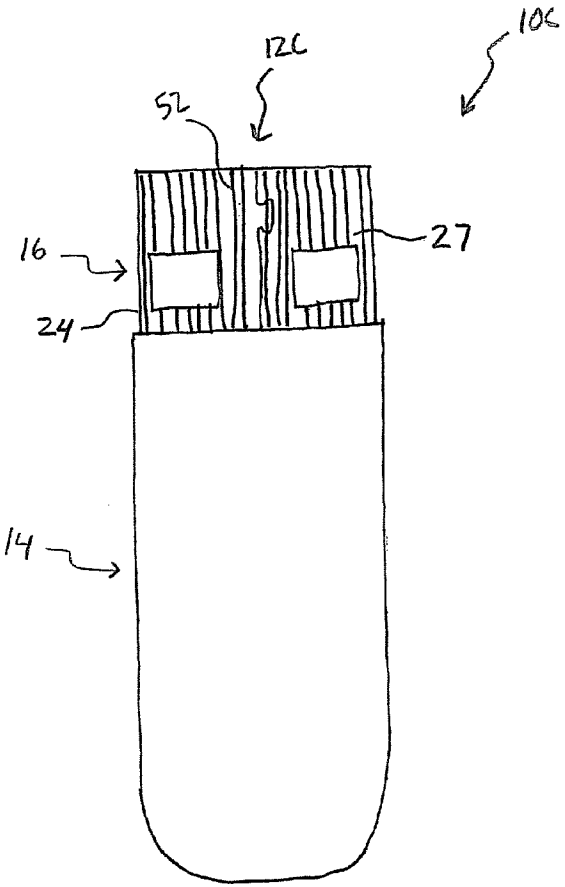
FIGS. 5A and 5B are top and bottom views, respectively, of a flash drive having a fourth exemplary embodiment of a configuration aid in accordance with the present invention.
Figure 5A:
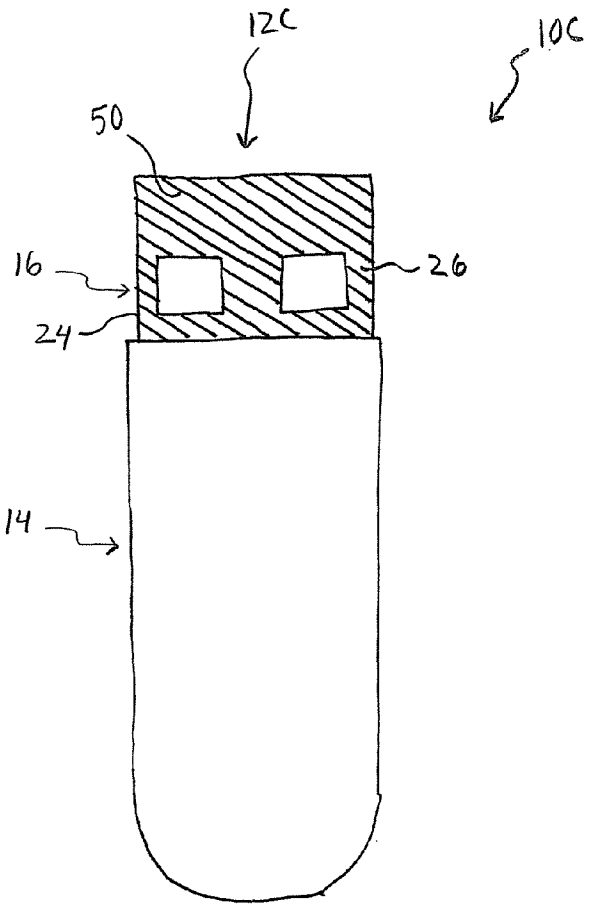

FIGS. 5A and 5B are top and bottom views, respectively, of a flash drive 10C having a fourth exemplary embodiment of a configuration aid 10C in accordance with the present invention. As illustrated in FIGS. 5A and 5B, configuration aid 12C is similar to configuration aid 12B of FIG. 4, but further includes a colored surface 52 on the bottom or second side 27 of the outer shell 24 of the connector 16. The second colored surface 52 is defined by a color that is different than the color defining the colored surface 50.

More particularly, the colored surface 50 is illustrated as extending across the entire first side 26 of outer shell 24 and being green in color, while the second colored surface 52 is illustrated as extending across the entire second side 27 of the outer shell 24 and being red in color. However, any colors or patterns that extend across at least a portion of the first and second sides 26 and 27 of the outer shell 24 and that allow the user to distinguish between the first and second sides may be used as will be appreciated by those skilled in the art. Thus, green and red colored surfaces are described merely for purposes of example and not limitation.

Similar to the colored geometrical shapes 42 and 44 of configuration aid 12A, the colored surfaces 50 and 52 of the configuration aid 12C indicate to the user which side of the outer shell 24 must be facing upward to properly orient the connector 16 with respect to a receptacle. Providing different colors on opposing sides of the outer shell 24 allows the user to associate one color with the "proper" orientation (such as green) and the other color with the "improper" orientation (such as red). Upon seeing the color associated with the "improper" orientation, the user immediately knows that the device must be rotated by 180 degrees in order to achieve the "proper" orientation.

Figure 6:
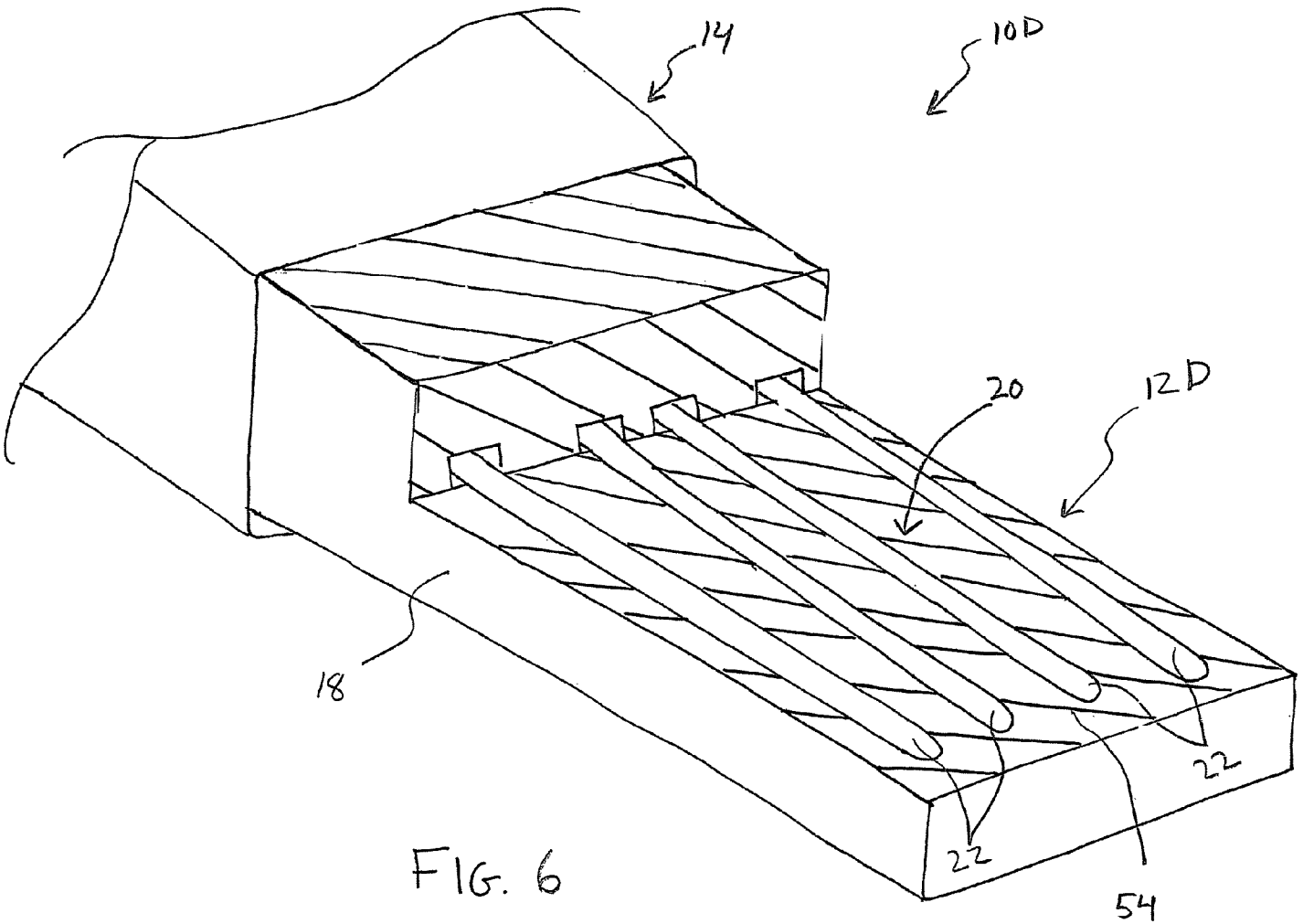
FIG. 6 is a perspective view of a flash drive having a fifth exemplary embodiment of a configuration aid in accordance with the present invention.

FIG. 6 is a perspective view of a flash drive 10D having a fifth exemplary embodiment of a configuration aid 12D in accordance with the present invention. As illustrated in FIG. 6, the outer shell 24 of the connector 16 has been removed such that the "bare" insulative seat body 18 extends from the flash drive housing 14. As will be appreciated by those skilled in the art, the outer shell 24 is not a necessary component of a male USB connector. Therefore, an electronic connection may be established between the terminals on the male connector and the terminals within the female receptacle without the outer shell being present. Unlike the various flash drive embodiments described above that included a configuration aid on an exterior surface of the outer shell 24 of the connector 16, the configuration aid 12D of flash drive 10D is instead formed on the first side 20 of the insulative seat body 18.

As illustrated in FIG. 6, the configuration aid 12D includes a colored surface 54 defined by a color that is different than the color of the remaining portions of the insulative seat body 18. More particularly, the colored surface 54 is illustrated as extending across the entire first side 20 of the insulative seat body 18 and being green in color. As discussed above with reference to colored surfaces 50 and 52 of configuration aids 12B and 12C, it is not necessary to have the colored surface 54 extend across the entire first side 20. Thus, in other embodiments the colored surface may extend across only a portion of the first side 20 of the insulative seat body 18. Furthermore, any color, pattern, or surface feature that allows the configuration aid 12D to be distinguished from the remaining portions of the insulative seat body 18 may be used. Thus, a green colored surface is described merely for purposes of example and not limitation.

Similar to the green colored circle 42 of configuration aid 12 and the green colored surface 50 of configuration aid 12B, the green colored surface 54 indicates to the user which side is the top or first side 20 of the insulative seat body 18 of the connector 16. By knowing which side is the first side 20, the user can properly orient the connector 16 with respect to a corresponding receptacle on the first attempt as previously described with reference to FIG. 2.

Figure 7B:
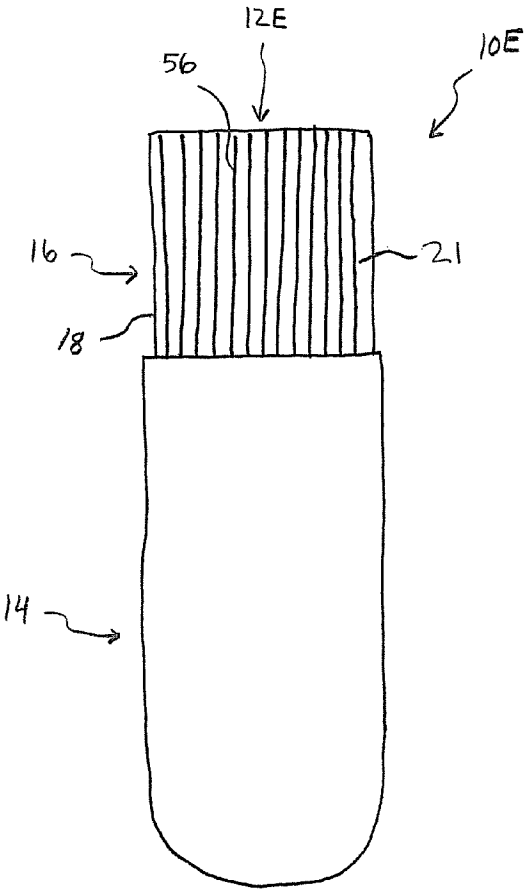
FIGS. 7A and 7B are top and bottom views, respectively, of a flash drive having a sixth exemplary embodiment of a configuration aid in accordance with the present invention.
Figure 7A:
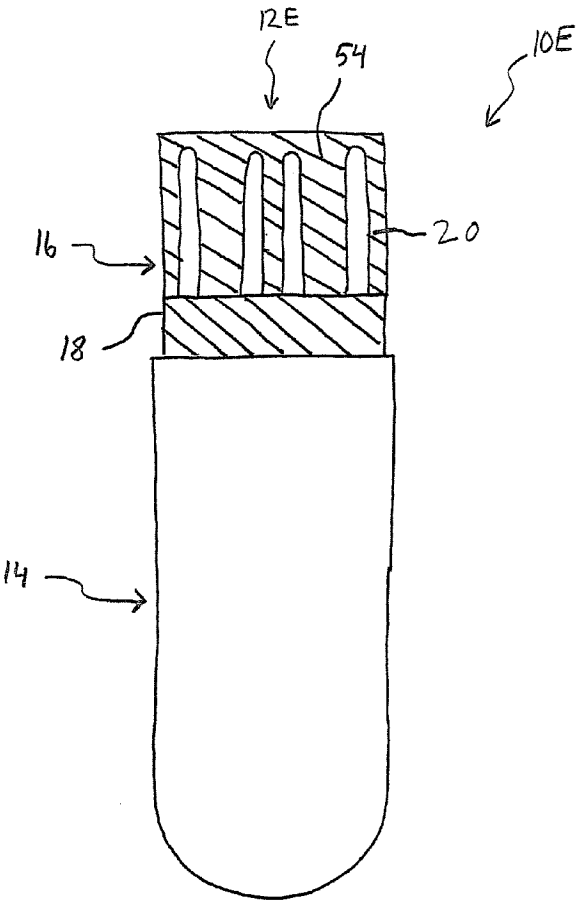

FIGS. 7A and 7B are top and bottom views, respectively, of a flash drive 10E having a sixth exemplary embodiment of a configuration aid 12E in accordance with the present invention. As illustrated in FIGS. 7A and 7B, configuration aid 12E is similar to configuration aid 12D of FIG. 6, but further includes a colored surface 56 on the bottom or second side 21 of the insulative seat body 18 of the connector 16. The second colored surface 56 is defined by a color that is different than the color defining the colored surface 54.

As illustrated in FIGS. 7A and 7B, the colored surface 54 extends across the entire first side 20 of the insulative seat body 18 and is green in color, while the second colored surface 56 extends across the entire second side 21 of the insulative seat body 18 and is red in color. However, any colors or patterns that extend across at least a portion of the first and second sides 20 and 21 of the insulative seat body 18 and that allow the user to distinguish between the first and second sides may be used as will be appreciated by those skilled in the art. Thus, green and red colored surfaces are described merely for purposes of example and not limitation.

Although the various embodiments of configuration aids in accordance with the present invention were described with reference to geometrical shapes and colored surfaces, those skilled in the art will appreciate that numerous other embodiments are also possible. For example, the configuration aid may comprise any lettering, numbering, symbol, or the like that allows a user to distinguish between the first and second sides of an electronic connector. Furthermore, the configuration aid may be "marked" on the connector with any suitable marking means, such as by printing, painting, dying, inscription, adhesive or the like.

The configuration aide may also include a sticker having a shape or color that is distinct from the shape or color of the outer shell to which the sticker is adhered. The configuration aid may also be raised or elevated relative to the surrounding outer shell surface, either by its own geometric characteristics or through that of the underlying outer shell where the configuration aid is located. For example, the outer shell may be raised in a circular, mound-like shape at the location of the configuration aid, such elevation being sufficiently low such that it will not materially affect the insertion of the outer shell into a receptacle but sufficiently high such that it increases the visibility of the configuration aid.

Alternatively, the outer shell may be recessed at the location of, and in substantially the same shape as, the configuration aid. For example, where the configuration aid includes a green circle, the outer shell may be recessed in a circular shape having approximately the same diameter as the configuration aid. Such recess allows the configuration aid, which may comprise any of the aforementioned embodiments including a colored paint or colored sticker, to be recessed slightly below the planar surface of the outer shell. The recess may have a depth of approximately 1.0 micron;

alternatively, the recess may have a depth of approximately 0.8-1.2 microns, or the recess may have a depth of approximately 0.2-2.0 microns. Thus, the configuration aid may comprise any distinguishable surface feature or characteristic without departing from the intended scope of the present invention.

As will be appreciated by those skilled in the art, USB receptacles such as receptacle 34 may be oriented in a direction different than that illustrated in FIG. 2. In one alternative orientation, the positions of the body 36 and the receptacle slot 40 may be opposite that illustrated in FIG. 2 such that the body 36 is positioned within the lower end and the receptacle slot 40 is adjacent the upper end. Alternatively, the receptacle 34 may be oriented such that the body 36 and the receptacle slot 40 are vertical instead of horizontal. Regardless of the particular orientation of the receptacle, the configuration aid of the present invention may be used to determine the proper orientation of a connector with respect to the receptacle. For example, if the positions of the body 36 and the receptacle slot 40 were opposite of that illustrated in FIG. 2, the user would know that in order to properly orient the connector 16 with respect to the receptacle 34 the green geometrical shape 42 of configuration aid 12 must be facing downward instead of upward.

In yet another embodiment, the USB receptacles such as receptacle 34, or the hardware connected to or in the proximity of the USB receptacle, may be configured with a transmitter, receiver, or transceiver, and the outer shell or another part of the electronic connector also includes a transmitter, receiver, or transceiver and further includes an illuminating component configured such that the configuration aid is the illuminating component, which illuminates when brought within a predetermined proximity to the USB receptacle. For example, the USB receptacle may be arranged with a transmitter or a magnetic field or other trigger, and the electronic connector is a USB flash drive that includes a receiver that receives the signal or field from the receptacle transmitter and illuminates an LED positioned on the flash drive housing when the flash drive is brought within a predetermined proximity of the receptacle.

Although the present invention has been described with reference to preferred embodiments, workers skilled in the art will recognize that changes may be made in form and detail without departing from the spirit and scope of the invention.

What is claimed is:

1. An electronic connector comprising:
- an outer shell having a first side and a second side;
- an insulative seat body having a first side and a second side, the insulative seat body disposed within an interior of the outer shell such that the first side of the insulative seat body is oriented toward the first side of the outer shell and the second side of the insulative seat body is oriented toward the second side of the outer shell;
- a plurality of terminals extending along the first side of the insulative seat body; and
- a configuration aid formed on the outer shell, the configuration aid structured to indicate the orientation of the terminals with respect to the first side of the outer shell.

2. The electronic connector of claim 1, wherein the configuration aid is a geometrical shape on the first side of the outer shell.

3. The electronic connector of claim 2, wherein the geometrical shape is colored green.

4. The electronic connector of claim 3, wherein the geometrical shape is a circle.

5. The electronic connector of claim 3, wherein the configuration aid further comprises a second geometrical shape on the second side of the outer shell.

6. The electronic connector of claim 5, wherein the second geometrical shape is colored red.

7. The electronic connector of claim 1, wherein the configuration aid is a colored outer surface on the first side of the outer shell.

8. The electronic connector of claim 7, wherein the colored outer surface is green.

9. The electronic connector of claim 8, wherein the configuration aid further comprises a second colored outer surface on the second side of the outer shell.

10. The electronic connector of claim 9, wherein the second colored outer surface is red.

11. An electronic connector comprising:
- a main body;
- an insulative seat body extending from the main body and having a first side and a second side;
- a plurality of terminals extending along the first side of the insulative seat body; and
- a configuration aid formed on the insulative seat body that is structured to allow a user to determine a proper orientation of the electronic connector with respect to a connector receptacle, wherein the configuration aid is defined by a colored surface on the first side of the insulative seat body that is different than a colored surface on the second side of the insulative seat body.

12. The electronic connector of claim 11, wherein the colored surface on the first side of the insulative seat body is green.

13. The electronic connector of claim 12, wherein the colored surface on the second side of the insulative seat body is red.

14. The electronic connector of claim 11, wherein the main body comprises a printed circuit board having a flash memory chip.

15. A memory system comprising:
- a memory unit having a printed circuit board with a flash memory chip enclosed within a housing;
- an electronic connector extending from the housing comprising:
  - an outer shell having a first side and a second side;
  - an insulative seat body having a first side and a second side, the insulative seat body disposed within an interior of the outer shell such that the first side of the insulative seat body is oriented toward the first side of the outer shell and the second side of the insulative seat body is oriented toward the second side of the outer shell; and
  - a plurality of terminals extending along the first side of the insulative seat body; and
- a configuration aid formed on the outer shell of the electronic connector, the configuration aid structured to indicate the orientation of the terminals with respect to the first side of the outer shell.

16. The memory system of claim 15, wherein the electronic connector is a Universal Serial Bus connector.

17. The memory system of claim 15, wherein the configuration aid is a geometrical shape on the first side of the outer shell having a color that is different than a color of the outer shell.

18. The memory system of claim 17, wherein the geometrical shape is green.

19. The memory system of claim 15, wherein the configuration aid is a colored surface that extends across at least a portion of the first side of the outer shell and is defined by a color that is different than a color of the outer shell.

20. The memory system of claim 15, wherein the configuration aid is defined by a colored surface on the first side of the outer shell that is different than a colored surface on the second side of the outer shell.

* * * * *

UNITED STATES PATENT AND TRADEMARK OFFICE

CERTIFICATE OF CORRECTION

PATENT NO. : 8,142,220 B2
APPLICATION NO. : 12/986555
DATED : March 27, 2012
INVENTOR(S) : Burns It is certified that error appears in the above-identified patent and that said Letters Patent is hereby corrected as shown below:

On the Title page, Item (54) and Column 1, line 1, delete

"CONNECTOR WITH A CONFIGURATION AID ON ITS OUTER SHELL OR AN INSULATIVE BODY DISPOSED IN THE OUTER CELL"

and insert:

--CONNECTOR WITH A CONFIGURATION AID ON ITS OUTER SHELL OR AN INSULATIVE BODY DISPOSED IN THE OUTER SHELL--

Signed and Sealed this
Twelfth Day of June, 2012

David J. Kappos

David J. Kappos
*Director of the United States Patent and Trademark Office*